US010943429B1

(12) United States Patent
LaDuca

(10) Patent No.: US 10,943,429 B1
(45) Date of Patent: Mar. 9, 2021

(54) METHOD AND DEVICE FOR PRESENTING AND PLAYING A CARD-TYPE GAME

(71) Applicant: AGS LLC, Las Vegas, NV (US)

(72) Inventor: Ronald Anthony LaDuca, Cherry Hill, NJ (US)

(73) Assignee: AGS LLC, Las Vegas, NV (US)

( * ) Notice: Subject to any disclaimer, the term of this patent is extended or adjusted under 35 U.S.C. 154(b) by 0 days.

(21) Appl. No.: 16/557,853

(22) Filed: Aug. 30, 2019

(51) Int. Cl.

| | |
|---|---|
| ***G07F 17/00*** | (2006.01) |
| ***G07F 17/32*** | (2006.01) |
| ***A63F 1/02*** | (2006.01) |
| ***A63F 1/06*** | (2006.01) |
| ***A63F 1/14*** | (2006.01) |

(52) U.S. Cl.
CPC ..... *G07F 17/322* (2013.01); *A63F 1/02* (2013.01); *A63F 1/067* (2013.01); *A63F 1/14* (2013.01); *G07F 17/3213* (2013.01); *G07F 17/3267* (2013.01); *G07F 17/3293* (2013.01)

(58) Field of Classification Search
None
See application file for complete search history.

(56) References Cited

U.S. PATENT DOCUMENTS

| | | | |
|---|---|---|---|
| 4,836,553 | A | 6/1989 | Suttle et al. |
| 4,861,041 | A | 8/1989 | Jones et al. |
| 5,393,067 | A | 2/1995 | Paulsen et al. |
| 5,472,194 | A | 12/1995 | Breeding et al. |
| 5,664,781 | A | 9/1997 | Feola |
| 5,685,774 | A | 11/1997 | Webb |
| 5,707,285 | A | 1/1998 | Place et al. |
| 5,743,800 | A | 4/1998 | Huard et al. |
| 5,785,606 | A | 7/1998 | Marquez |
| 5,911,418 | A | 6/1999 | Adams |
| 5,984,779 | A | 11/1999 | Bridgeman et al. |
| 6,206,373 | B1 | 3/2001 | Garrod |
| 6,299,532 | B1 | 10/2001 | Smith |
| 6,299,534 | B1 | 10/2001 | Breeding et al. |
| 6,637,747 | B1 | 10/2003 | Garrod |

(Continued)

FOREIGN PATENT DOCUMENTS

| | | |
|---|---|---|
| AU | 2015203880 | 7/2015 |
| WO | 2000/016868 | 3/2000 |

OTHER PUBLICATIONS

Pai gow poker—Wikipedia, the free encyclopedia, https://wikipedia.org/wiki/Pai_gow_poker, Jun. 6, 2016, 4 pages.

(Continued)

*Primary Examiner* — Paul A D'Agostino
(74) *Attorney, Agent, or Firm* — Weide & Miller, Ltd.

(57) ABSTRACT

In a method of presenting a game, a player places a game play wager and one or more optional bonus bets, such as via an input receiving device of a gaming table. Seven cards are dealt to each player and a dealer. The player and dealer attempt to form a highest ranking Straight, Flush or Straight Flush hand. The outcome of the player's game play wager is determined with reference to a rank of the dealer's hand or the player's hand as compared to the dealer's hand. The optional bonus bets are resolved with reference to the rank of the player's hand. Awards for winning game play wagers or bonus bets may be awarded in accordance with a pay table or via a wheel spin or other award selection event which is initiated by the player, such as to the input receiving device.

16 Claims, 5 Drawing Sheets

(56) References Cited

U.S. PATENT DOCUMENTS

| | | | | |
|---|---|---|---|---|
| 6,929,264 | B2 | 8/2005 | Huard et al. | |
| 7,566,274 | B2 | 7/2009 | Johnson et al. | |
| 7,641,198 | B2 | 1/2010 | Ko et al. | |
| 7,651,394 | B2 | 1/2010 | Johnson | |
| 7,931,532 | B2 | 4/2011 | Johnson | |
| 8,096,556 | B2 | 1/2012 | Chamberlain et al. | |
| 8,191,897 | B2 | 6/2012 | Ritner, Jr. et al. | |
| 8,740,692 | B2 | 6/2014 | Yoseloff et al. | |
| 8,961,298 | B2 | 2/2015 | Czyzewski et al. | |
| 9,478,099 | B2 | 10/2016 | Czyzewski et al. | |
| 9,536,379 | B2 | 1/2017 | Czyzewski et al. | |
| 9,662,563 | B2 | 5/2017 | Van Asdale et al. | |
| 9,811,980 | B1 | 11/2017 | Kowalchuk et al. | |
| 10,373,444 | B2 | 8/2019 | Hemberger et al. | |
| 10,395,470 | B2 | 8/2019 | Czyzewski et al. | |
| 2002/0195773 | A1* | 12/2002 | Dunn | G07F 17/3244 273/274 |
| 2003/0114209 | A1 | 6/2003 | Ritner, Jr. et al. | |
| 2003/0153377 | A1 | 8/2003 | Lisowski, Sr. | |
| 2004/0061288 | A1 | 4/2004 | Snow | |
| 2004/0090005 | A1 | 5/2004 | Snow | |
| 2004/0183254 | A1 | 9/2004 | Schlumbrecht | |
| 2005/0107148 | A1 | 5/2005 | Webb | |
| 2007/0126186 | A1 | 6/2007 | Crawford, III et al. | |
| 2007/0170652 | A1 | 7/2007 | Perrie et al. | |
| 2009/0104962 | A1 | 4/2009 | Nicely et al. | |
| 2010/0087241 | A1 | 4/2010 | Nguyen et al. | |
| 2010/0113120 | A1* | 5/2010 | Snow | G07F 17/32 463/16 |
| 2011/0034237 | A1 | 2/2011 | Schulhof et al. | |
| 2011/0175290 | A1 | 7/2011 | Huynh | |
| 2011/0316233 | A1 | 12/2011 | Hong et al. | |
| 2012/0083341 | A1 | 5/2012 | George et al. | |
| 2012/0244924 | A1 | 9/2012 | Willis | |
| 2013/0157752 | A1 | 6/2013 | Yoseloff | |
| 2014/0200071 | A1 | 7/2014 | Czyzewski et al. | |
| 2015/0018083 | A1 | 1/2015 | Czyzewski et al. | |
| 2015/0199871 | A1 | 7/2015 | Czyzewski et al. | |
| 2015/0379821 | A1 | 12/2015 | LaDuca | |
| 2016/0267746 | A1 | 9/2016 | Yee et al. | |
| 2017/0039799 | A1 | 2/2017 | Czyzewski et al. | |
| 2017/0203198 | A1 | 7/2017 | Lysowski et al. | |
| 2017/0249805 | A1* | 8/2017 | Johnston | G07F 17/3293 |

OTHER PUBLICATIONS

International Search Report and Written Opinion for Application No. PCT/US2017/031511, dated Aug. 7, 2017, 19 pages.

International Search Report and Written Opinion for Application No. PCT/US2017/031560, dated Aug. 9, 2017, 20 pages.

Shanghai Lanbao Sensing Technology Co., Ltd., "CR30S-Products,"http://www.shlanbao.cn/en/product/show.aspx?Id-1139. Copyright 2011, printed Oct. 21, 2016, 2 pages.

State of Washington Gambling Commission, "High Card Flush," http://www.wsgc.wa.gov/activities/game-rules/high-card-flush.pdf, May 28, 2013, 14 pages.

State of Washington Gambling Commission, "Ultimate Texas Hold 'Em Training Manual," http://www.wsgc.wa.gov/activities/game-rules/ultimate-texas-hold-em.pdf, Aug. 11, 2014, 23 pages.

Stmicroelectronics, VL6180X—Proximity sensor, gesture and ambient light sensing "ALS" module, http://www.st.com/en/imaging-and-photonics-solutions/v/16180x.html, Copyright 2016, printed Oct. 21, 2016, 6 pages.

Wikipedia, "Euchre," https://en.wikipedia.org/wiki/Euchre, printed Oct. 19, 2016, 4 pages.

International Search Report and Written Opinion for PCT/US2017/012156 dated Mar. 13, 2017, 27 pages.

Omaha hold 'em—Wikipedia, the free encyclopedia, "https://en.wikipedia_org/w/index.php?title=Omaha_hold_%27em&oldid=722451289", May 28, 2016, 6 pages.

State of Washington Gambling Commission, "Mississippi Stud Training Manual," http://www.wsgc.wa.gov/activities/game-rules/mississippi-stud.pdf, Oct. 28, 2014, 17 pages.

State of Washington Gambling Commission, "Texas Hold 'Em Bonus Training Manual," http://www.wsgc.wa.gov/activities/game-rules/texas-hold-em-bonus.pdf, Oct. 28, 2014, 15 pages.

Texas hold 'em—Wikipedia, the free encyclopedia, "https://en.wikipedia_org/w/index.php?title=Texas_hold_%27em&oldid=718982670", May 6, 2016, 18 pages.

Galaxy Gaming, Inc., High Card Flush—Rules, https://www.high-card-flush.com/rules.html, printed Jan. 14, 2020, 1 page.

* cited by examiner

METHOD AND DEVICE FOR PRESENTING AND PLAYING A CARD-TYPE GAME

FIELD OF THE INVENTION

The present invention relates to methods of presenting and playing games and devices configured to present games.

BACKGROUND OF THE INVENTION

Table games are a very popular form of wagering games. These games are referred to as table games because they are presented at a gaming table rather than at a gaming machine. These games include, but are not limited to, blackjack, poker, baccarat and other types of card games, as well as roulette, craps and other types of games. Despite the many existing games, game players continue to seek new and different games and devices for presenting those games.

While players continue to seek new games, the development of a successful game depends on a myriad of intertwined criteria. For example, players desire games which are sufficiently challenging to retain their interest, but yet not too challenging to play or difficult to learn. In addition, the game must be configured so that it not only offers a reasonable rate of return/chance to win to the player, but in the case of games played again the house, offers the house a reasonable rate of return on the game. If the rate of return on a game to the house is too low, casinos will not offer the game and yet if the rate of return to the player is too low, the player will not play the game. Also the style or nature of the game can be important. For example, many players do not like to play directly against other players, but would rather only play against a paytable or a dealer.

Even games which have been developed which satisfy some of these issues still have drawbacks. For example, in the game of High Card Flush which is offered by Galaxy Gaming, players play against a dealer, wherein each player and the dealer are dealt a hand of cards. The game is relatively simple in that a player simply attempts to form the best Flush hand (greatest number of cards of the same suit), wherein the outcome of the player's wager depends upon whether the dealer has a qualifying hand and/or whether the player's Flush hand outranks the dealer's Flush hand.

While this game offers player versus dealer play and is relatively simple, it has various drawbacks. First, while the game is relatively simple in that a player only needs to try and form a Flush hand (as compared, for example, to games of poker where a player may attempt to form any number of poker hands including a Pair, Two Pair, Three of a Kind, Flush, Four of Kind, Full House, Straight, Flush and Straight Flush), the player's opportunity to form a winning hand is limited to only Flushes. Thus, even if the player has cards which comprise other poker hands, those combinations of cards are unusable and will be losing. Also, in the game of High Card Flush, a player must place an ante wager at the beginning of the game and then loses that wager if they do not place a raise wager after they are dealt their cards (but before they see the dealer's hand). This second wager is a high risk wager to the player.

Another player versus dealer game is disclosed in U.S. Pat. No. 8,096,556 to Chamberlain. In this game, a player must place an ante wager and is then dealt a first number of cards. The player must then place a second wager or fold. If the player places the second wager, the player is dealt a second number of cards. The player then attempts to form their best Straight, Flush or Straight Flush hand.

Again, while this game offers player versus dealer play and is relatively simple, it also has various drawbacks. For example, the player must again place two wagers in order to remain in the game. In this case, the player must place the second wager before they have even seen all of their cards. Thus, a player whose initial set of cards is not extremely favorable will likely desire to fold, losing their ante wager. This creates very unfavorable leverage for the house, as viewed by the player. Also, in this game, the player's final hand must qualify. If the player's hand does not qualify, they lose their wagers, regardless of the dealer's hand.

Many existing games also suffer from problems associated with implementing the game. For example, most table games are implemented by having players place wagers with chips. The player moves chips that they wish to wager onto the playing surface of the table. The player must manually count the chips and determine their value and the dealer must receive the chips (e.g. notice that the player has tendered them for wager within the required wagering period) and must manually count the chips in order to verify the wager. Also, players are generally awarded winnings of fixed amounts for winning outcomes, such as based upon a predefined pay table.

In this configuration, the tendering and acceptance of chips for wagering is a cumbersome and time consuming process which slows down the game. Also, players know exactly what award they will receive for a winning outcome—e.g. there is no variation or excitement associated with determining the award for a winning outcome (including because the outcomes are fixed and do not change).

The present invention addresses these and other objectives.

SUMMARY OF THE INVENTION

Embodiments of the invention comprise methods of implementing and presenting games, as well as gaming devices such as gaming tables and systems for presenting the games.

One embodiment of the invention comprises a method of presenting a card game to at least one player using physical playing cards at a uniquely configured game table which includes one or more input receiving devices and at least one display device. In one embodiment, the game is played by a player against a dealer.

In one embodiment of a method of playing and presenting a card game, a game play wager is received from each player along with one or more optional bonus bets. Seven physical playing cards are dealt to each player (who placed a game play wager) and the dealer. Each player and the dealer attempt to form a highest ranking hand. Preferably, hands are ranked by the highest number of cards of each of hand types ranked from highest to lowest of Straight Flush, Flush and Straight, wherein a hand with a higher number of cards of any hand type outranks a hand of a lower number of cards of any hand type, whereas between hands having the same number of cards of one of the hand types, the hand with the highest ranked hand type is ranked the highest, and wherein when hands have the same number of cards of the same hand type, then the hand with the highest ranked card or cards outranks the other hand.

The outcome of the player's game play wager is determined with reference to a rank of the dealer's hand, or the player's hand as compared to the dealer's hand. In one embodiment, an outcome of the player's game play wager is a first winning outcome if the rank of the dealer hand does not meet a predetermined qualifying rank; an outcome of the player's game play wager is a push if the rank of the dealer hand the rank of the player hand are the same; an outcome of the player's game play wager is losing if the rank of the dealer hand is higher than the rank of the player's hand; and the player's game play wager is a second winning outcome if the rank of the player's hand is higher than the rank of the dealer hand.

In one embodiment, the optional bonus bets are winning regardless of the outcome of the player's game play wager or whether the dealer's hand qualifies. Preferably, the optional bonus bets are resolved with reference to the rank of the player's hand. In one embodiment, the one or more optional bonus bets comprise a Flush bonus bet that is winning if the player's hand is a Flush having 4 or more cards. Another optional bonus bet may comprise a Straight Flush bonus bet that is winning if the player's hand comprises a 3 to 7 card Straight Flush. Yet another optional bonus bet may comprise a Straight to the Wheel bonus bet that is winning if the player's hand comprises a 5, 6 or 7 card Straight.

In one embodiment, one or more of the player's wager or bonus bets are received by the at least one input receiving device, such as by sensing the player's location of at least one wagering chip in the proximity of the at least one receiving device.

In one embodiment, an award for a winning wager or bet may be paid according to one or more pay tables. In another embodiment, the award for a winning wager or bet, such as a winning Straight to the Wheel bonus bet may be determined by an award selection event. The award selection event may comprise a wheel spin event in which a wheel segment selection event is displayed via the display device at the gaming table, wherein the selected segment has an associated award value, and wherein the award selection event is initiated by receiving a player's input via the at least one input receiving device.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of implementing (playing and presenting) games, and devices and systems for implementing or presenting games. In a preferred embodiment, the methods of game play and presentation are implemented relative to a gaming table.

Figure 1:
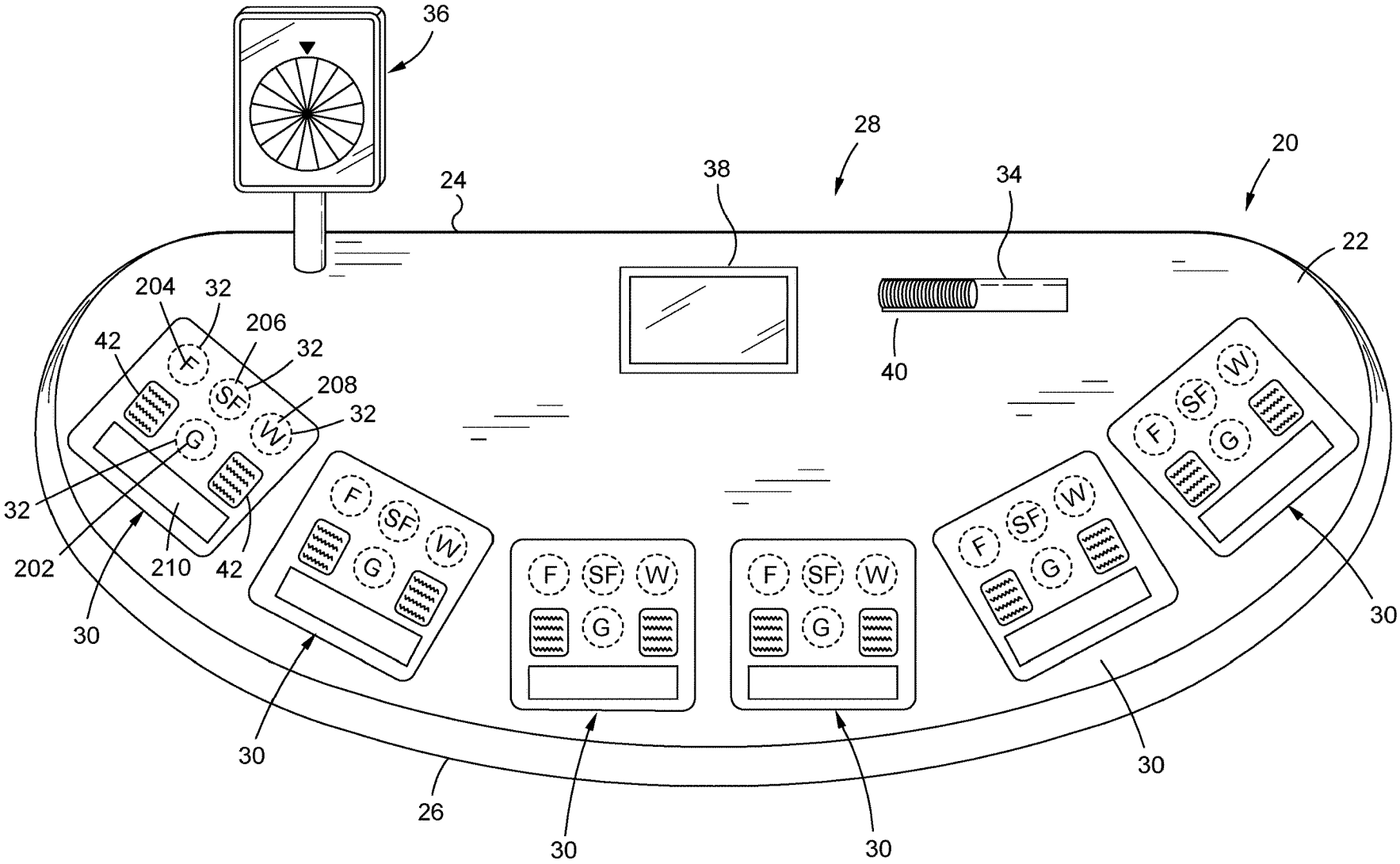
FIG. 1 illustrates a gaming table in accordance with one embodiment of the invention.

One embodiment of a gaming table in accordance with the invention will be described with reference to FIG. 1. As illustrated in FIG. 1, a game playing surface, such as a gaming table 20, is provided. The gaming table 20 defines a top or playing surface 22. The gaming table 20 may include one or more supports, such as a base, legs or the like (not shown) via which the playing surface 22 is elevated above a supporting surface such as a gaming floor.

The shape of the playing surface 22 may vary. In one embodiment, the gaming table 20 has a rear having a rear edge 24 which is generally straight and has an opposing front having a front edge 26 which is generally arcuate. A bumper or cushion may be located at either or both edges 24,26.

In one embodiment, the playing surface 22 is generally planar. However, the playing surface 22 could have one or more raised areas and/or one or more depressed areas or other features which are integrated into the table or added to the table, such as by being located on or mounted to the top surface thereof. Various game-related information or features are preferably associated with the gaming table 20. In one embodiment, the playing surface 22 comprises a gaming felt or similar element(s) which are located over a substrate, such as a planar support. The gaming felt may bear game play information or other information, such as by printing on the felt. This information may vary, such as depending upon the game or games which are to be implemented at the gaming table 20. For example, printing on the gaming felt may comprise one or more pay tables 42, card locations and the like.

In one embodiment, the configuration of the gaming table 20, such as via elements which are associated with the table 20 and information printed on the gaming felt, defines a dealer station 28 where a dealer may run a game, and one or more player positions 30. The dealer station 28 is generally located at the rear edge 24 and the player positions 30 are located opposite the dealer station 28 at the front or front edge 26. The dealer may, for example, stand at the rear of the table adjacent to the dealer station 28. A player may stand or sit adjacent to each player position 30 at the front of the gaming table 20.

In one embodiment, the game which is presented at the gaming table 20 comprises a wagering game. Wagers may be placed using physical gaming chips or other elements. In one embodiment, wagers by players may be sensed by detecting the association of one or gaming chips (or monies or other wagering implements) with one or more input receiving devices or input sensors 32. The input receiving devices or input sensors 32 might comprise buttons (wired or wireless), or other input device, but preferably comprise proximity sensors. The input receiving devices 32 may be located in or on the gaming table 20 and are configured to detect inputs, such as provided by players at the playing surface 22. In the case of proximity sensors, the sensors may be any type of proximity sensor now known or later developed, such as IR, acoustic, capacitive, or the like. In other embodiments, other types of sensors might be utilized, such as RFID or the like.

For example, the input receiving devices 32 might comprise capacitive type sensors such as Lanbao CR30S series capacitive sensors (produced by Shanghai Lanbao Sensing Technology Co.; www.shlanbao.cn), which sensors behave as standard electrical 4-pin switches where the switch status changes when a chip (or other object, such as a player's hand) is placed on it. In another embodiment, the input receiving devices or sensors 32 might comprise a light sensing device which measures the distance between the sensor and a chip (or other object, such as a player's hand), such as the VL6180X ambient light sensing proximity sensor produced by STMICRO (www.st.com).

In one embodiment, one or more input receiving devices 32 are associated with each player position 30, thereby providing a means for each player to provide input relative to game play at the gaming table.

In one embodiment, the dealer station 28 may include one or more chip trays 34 which are located on or at the gaming table 20 for storing chips 40 which may be used to pay player winnings and/or in which chips which were used by players to place wagers may be collected.

In one embodiment, the gaming table 20 may include a number of other features. For example, the gaming table 20 may include one or more table displays 36. The table display 36 may comprise an electronic video display (such as an LCD, LED, OLED, DLP or other types of displays which are now known or later developed) or might even comprise a mechanical and/or electro-mechanical display device such as one or more spinning wheels or reels. The table display 36 may be located at or near the gaming table 20 for use in displaying game related information such as pay table information, game status information, game outcome information, bonus information or the like. The table display 36 might also be used to display promotional information or advertising.

The gaming table 20 might also comprise or include various input devices and/or other display devices. The input devices might include one or more dealer input devices such as one or more buttons or a dealer touchscreen display 38. For example, the dealer display 38 might comprise a display which displays game-related information to the dealer and allows the dealer to provide various inputs. Of course, various other types of input and display devices might be associated with the gaming table 20. The gaming table 20 might also include player touch-screens, inputs buttons or the like.

Additional details of a gaming table in accordance with one embodiment of the invention will be described with reference to FIG. 2. As illustrated, in this embodiment, elements of the gaming table 20 are associated with or connected to at least one table controller 100. The table controller 100 may be located at the gaming table 20 or may be remote therefrom.

In one embodiment, the table controller 100 comprises at least one processor 102 which is configured to execute machine readable code fixed in a tangible medium (e.g. "software"). The table controller 100 may also comprise one or more information or data storage devices 104. These data storage devices 104 may comprise any type of data storage device such as ROM, RAM, EPROM or the like, as well as mass storage devices such as hard drives. The data storage devices 104 may store various data, including game code or software which is executable by the processor(s) 102 and other data, such as game data including wager data, game outcome data, images, etc.

The table controller 100 preferably includes one or more communication interfaces 106. The communication interface(s) 106 may facilitate wireless and/or wired communications with one or more remote systems or devices in accordance with various protocols (USB, Wi-Fi, Bluetooth, Ethernet, Firewire, etc.). In one embodiment, data or information may be exchanged between the processor(s) 102, data storage device(s) 104 and communication interface(s) 106 via one or more interfaces, such as a system bus 108. Of course, the table controller 100 might have other configurations, including other elements or features.

Figure 2:
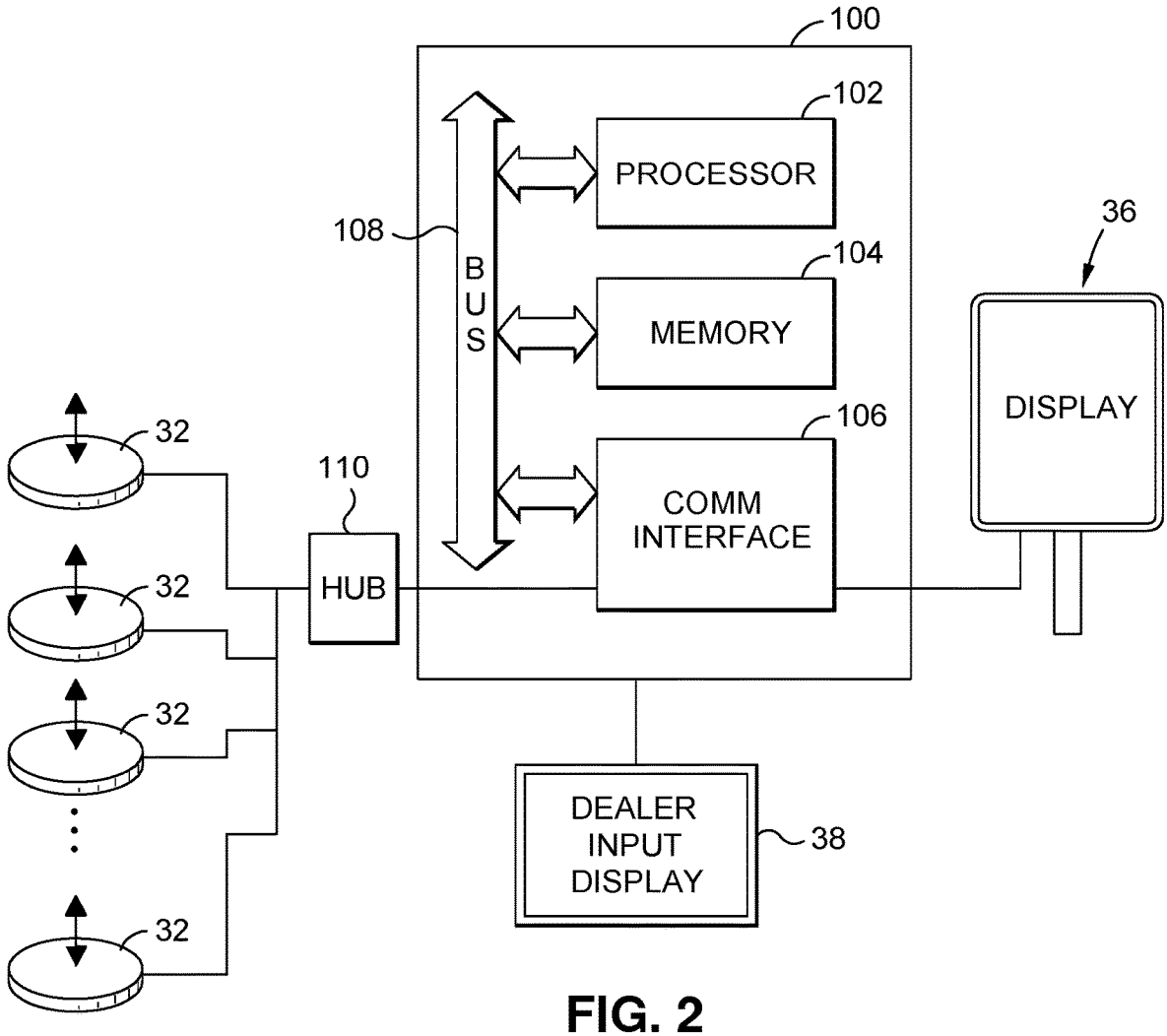
FIG. 2 illustrates a gaming system in accordance with one embodiment of the invention.

As illustrated in FIG. 2, the one or more input receiving devices 32 of the gaming table 20 may be interfaced with the table controller 100 to that the table controller 100 may receive information from those devices 32 and, in some embodiments, to transmit information to those devices. Likewise, the dealer input and/or display devices, such as the dealer touchscreen 38, may be interfaced to the table controller 100. Also, other input and/or display devices such as the table display 36 may be interfaced to the table controller 100.

In one embodiment, the table controller 100 or other devices associated with the gaming table 20 may determine player monetary or chip value balances, including based upon monies associated with the table by the player (such as chips purchased), amounts wagered and amounts won or the like.

The gaming table 20 of the invention may include or be associated with other elements or devices. For example, the gaming table 20 might include other gaming equipment, such as one or more player displays (such as located at each player position and configured to display game information, player tracking information, advertising or other information), card shoe(s), card reader(s), card shuffler(s), player tracking devices (such as for reading a player tracking card or other media of a player for use in tracking the player's game play) and the like. The gaming table 20 might also be connected to external devices. For example, the table controller 100 might be connected to one or more casino servers or systems, such as a casino accounting server which tracks game play at each gaming table 20, such as relative to the amounts of wagers placed and winnings paid to the players, among other information. The gaming table 20 might also be connected to a player tracking server and include player tracking elements such as player card readers.

The gaming system might include other elements, such as input receiving device controllers or the like. In one embodiment, the input receiving devices 32 communicate with a hub or aggregator 110 which communicates with the table controller 100. The hub 110 may be configured to read or determine the status of each input receiving device 32 and provide information to the table controller 100, such as when the status of an input receiving device 32 changes. The hub 110 may also comprise a power source for the input receiving devices 100. As another example, a proximity-type input sensor might be configured as a USB type device having a USB controller. The table controller 100 may be configured to control the proximity device as a USB device. In this regard, the processor 102 and/or one or more sub-processors or controllers may be utilized to control the input receiving devices.

In one embodiment of the invention, different input devices might be utilized for receiving different inputs (such as one input device for receiving a wager input and another input device for receiving a "spin" input or the like). In another embodiment, the one or more input receiving devices 32 are configured to receive multiple inputs. Each input receiving device 32 may be configured to receive two or more inputs. The inputs may be game-related inputs by a player and comprise two or more different types of inputs at two or more different times.

In one or more embodiments of the invention, aspects of the input receiving devices 32 and/or other devices or elements may be controlled or utilized to facilitate the receipt of the different player inputs. For example, the input receiving devices 32 and/or the table controller 100 may be configured to control the receipt of inputs, such as by selectively activating and deactivating the input receiving devices 32 so that they will receive input at certain times, but not others. In other embodiments of the invention described below, the configuration of the input receiving devices 32 may change to facilitate the input(s), such as by changing a detecting sensitivity to detect an intended player input from an unintended input. In yet other embodiments described herein, one or more secondary elements, such as audible and/or visual indicators may be used in conjunction with the input receiving devices 32 to facilitate the input receiving functionality of the input receiving devices 32.

In one example embodiment of the invention, such as disclosed in more detail below, a wagering game may be presented at the gaming table 20. The game may have a base game portion and a secondary or bonus game portion. For example, the base game portion may comprise a card game which is played with one or more decks of physical playing cards. The bonus game might comprise a bonus wheel spin for a potential bonus award. As detailed herein, however, other types or configurations of games which require player input may be implemented relative to the invention.

In one embodiment, the input receiving devices 32 may be turned off or be configured to not receive inputs except during designated times. This prevents, for example, inadvertent inputs from being received when games are not being presented or when other activities are occurring. For example, it may be preferable for the input receiving devices 32 to not receive inputs between games or during certain portions of a game.

In one embodiment, the input receiving devices 32 may be turned off by providing an instruction to them to not receive or transmit inputs. In other embodiments, the table controller 100 could be configured to ignore input signals from the input receiving devices 32.

In one embodiment, the input receiving devices 32 may be "activated", such as by turning them on or by causing the table controller 100 to be configured to receive inputs from the input receiving devices 32. This step may be implemented by a dealer, such as by input to the one or more dealer input devices. For example, the dealer display 38 might display a "start game/receive wagers" button which the dealer may select. In response to that input, the table controller 100 may be configured to receive inputs from the input receiving devices 32 or may send control instructions to those devices to cause them to be activated.

After activation, one or more first inputs may be provided to the one or more input receiving devices 32. This may comprise, for example, a first type of input such as a wager input, such as via the detection of one or more chips.

In one embodiment, each player who wishes to play the game may be required to place one or more wagers. The player might optionally be permitted to place other wagers. For example, a player might be required to place one or more base wagers to play the game and might be permitted to optionally place a bonus bet or wager. In one embodiment, one or more input receiving devices 32 are associated with each player position 30. More than one input receiving device 32 may be provided relative to each player, such as for receiving a base wager and a bonus wager.

Figure 3A:
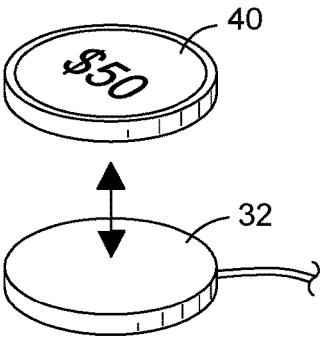
FIGS. 3A and 3B illustrate first and second inputs to an input receiving device in accordance with the present invention.

In one embodiment, a wager input may be provided by a player placing one or more chips 40 on or adjacent to a particular input receiving device 32, such as illustrated in FIG. 3A. At that time, the wager input(s) may be detected by those devices 32 and may be transmitted to the table controller 100 for processing. Wager information may be displayed to the dealer, such as via the dealer display 38. The dealer might then collect the wagers and place the wagered chips in the chip tray 34.

In one embodiment, after a first input period, the input receiving devices 32 may again be de-activated. Once again, this may comprise a dealer providing input to the dealer input device(s), such as the dealer touchscreen 38. For example, the dealer touchscreen 38 might display a "close wager" button which the dealer may select. This may cause the table controller 100 to no longer receive inputs from the input receiving devices 32 and/or to send a control instruction to those devices to de-activate them.

At one or more times, the input receiving devices 32 may be configured to receive one or more additional or second inputs. Such a secondary input might comprise a secondary or other additional wager. One or more of the secondary inputs may comprise a different type of input than the first input. In order to receive the at least one secondary input, the input receiving devices 32 may again be re-activated. In one embodiment, only certain input receiving devices 32 may be activated for receiving particular inputs. For example, a player who placed a bonus wager and received a certain bonus-triggering result from the play of a base game might be permitted to participate in a bonus event, such as a bonus wheel spin. As described below, in another embodiment, a player might be entitled to spin award wheel which selects or reveals one or more awards, such as an award for a winning bet. Preferably, the input receiving devices 32 corresponding to only those players who are entitled to participate in the bonus event, award event or the like might be activated. The input receiving devices 32 relative to the other players preferably remain inactive, such as to prevent accidental input thereto.

Figure 3B:
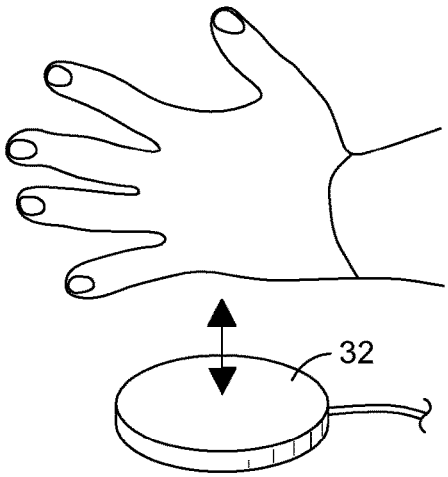

In one embodiment, an input might comprise a player placing their hand, one or more fingers or another body part or the like on or adjacent to the input receiving device 32, or waving their hand across the device, such as illustrated in FIG. 3B (for example, using the above-referenced VL6180X ambient light sensing sensor, the sensor detects the presence of the player's hand proximate to the sensor (by determining a distance of the player's hand from the sensor by determining a flight time of projected light which is reflected from the player's hand back to the sensor) in order to receive the player's hand input). In response, one or more game features or the like may be implemented by the table controller 100 and/or dealer in response to the received input. For example, in response to the detection of a player's hand, an input receiving device 32 may send a signal to the table controller 100. The table controller 100 may then be configured to cause the table display 36 to display the image of a wheel which rotates and then stops at a selected award or bonus location, such as illustrated in FIG. 1. The bonus spin outcome or award selection event may result in the player being awarded a bonus win or a selected award. Of course, this process might be repeated relative to each player who is entitled to a bonus spin or award selection event. In one embodiment, the input receiving device 32 corresponding to a first player is activated and receives an input from that player, the bonus element or other feature is implemented and then that input receiving device 32 may be inactivated. The input receiving device 32 relative to a second player may then be activated, and so on.

Figure 4:
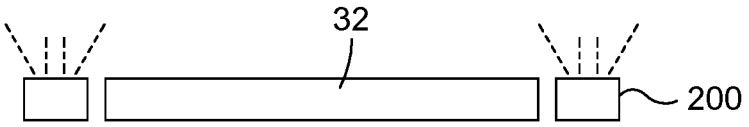
FIG. 4 illustrates an input receiving device having an associated indicator in accordance with one embodiment of the invention.

In one embodiment, the system might include one or more input receiving device indicators. These indicators might comprise, for example, audible and/or visual indicators. The indicators may provide an indication, such as by sound, light (including color), text or the like, of a status of an input receiving device 32 or an activity associated therewith. As one example, a visual indicator such as a color or multi-color light ring 200 might be located around an input receiving device, such as illustrated in FIG. 4. Of course, such an indicator might otherwise be located adjacent to an input receiving device 32 or even over such a device. The indicator lights might be located inside the device if the device is equipped with a translucent surface.

In one embodiment, the indicator(s) might provide an indication or information to a user comprising one or more of: (1) an inactive status of the input receiving device; (2) an active or ready for input status of the input receiving device; and (3) accepted or received input to the input receiving device. In one embodiment, the one or more indicator(s) are controlled in conjunction with the input receiving devices, such as via the table controller.

As one example, when an input receiving device is inactivate, an associated indicator (such as a light ring around the input receiving device) might be illuminated red. When it is active, and ready for a particular input, it might be illuminated flashing green. When an input is received, the flashing green light might transition to a steady green light.

Figure 5A:
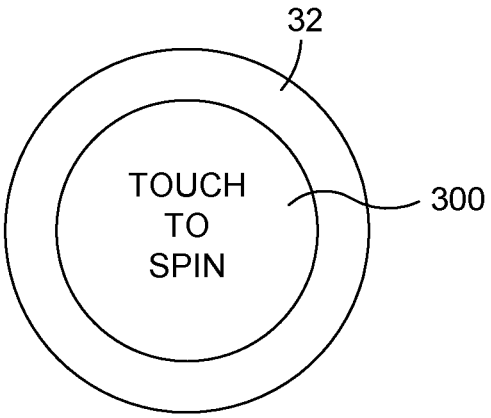
FIGS. 5A and 5B illustrate an input receiving device having an associated indicator in accordance with another embodiment of the invention.
Figure 5B:
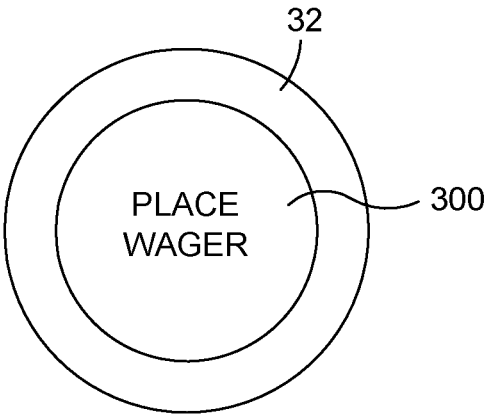

In another embodiment, text or other instructions might be displayed by the one or more associated indicators. For example, as illustrated in FIGS. 5A and 5B, a video screen 300 may be located over or may be located adjacent to an input receiving device 32. The video screen 300 might display "place wager" when the input receiving device is configured to receive a wager (as shown in FIG. 5B) and might display "touch to spin" or other instructions when the input receiving device is configured to receive a player spin input (as shown in FIG. 5A).

Of course, the indicator(s) may have various configurations. Preferably, the indicator(s) are located adjacent to or are associated with (and may even be integrated with) the input receiving device(s) 32.

As one example of the use of an input device where one or more indicators are utilized, an indicator associated with an input receiving device or sensor 32 may be activated to indicate to a player that their input receiving device 32 is ready to accept a wager. This might comprise, as indicated above, causing the indicator to illuminate a flashing green light, to cause a display to show a "place wager" instruction or the like. The input receiving device 32 may then receive an input in the form of one or more chips placed by the player.

The indicators may then be activated to indicate that the wager period is closed. This might comprise, for example, the indicators being illuminated red or displaying a "wagers closed" instruction or the like. Thereafter, such as after various steps of the game, an indicator may be activated to indicate that an associated input receiving device or sensor 32 is ready for a bonus spin input. This may comprise the indicator illuminating a flashing green light, showing a "touch to spin" instruction or the like, after which a player's input to the associated input receiving device 32 may be detected.

In one embodiment, the indicator may be activated to indicate that the input was received from the player. For example, once the input receiving device 32 detected the player input and sent information regarding this input to the table controller 100, the table controller 100 may cause the indicator to display a steady green light or to display an "input received" indication. Thereafter, the game feature might then be implemented based upon the player input.

Of course, at a gaming table where multiple players are playing, the indicators may indicate a particular status of an input receiving device corresponding to each player, where the status may vary from player to player. This allows the indicators to provide information to each player which is unique to that player. For example, during a bonus spin or award selection event phase, only the indicator associated with the input receiving device of a player whose turn it is to spin may indicate such (while the indicators associated with the input receiving devices of the other players may indicate that no input is to be provided by those players).

Of course, the indicators may be used in various manners. For example, the indicators might always be activated in a manner which confirms a player input, whether of a wager or a direct input, rather than just a player's direct input. In one embodiment, the status of the indicators may be automatically controlled by the table controller 100 or might be controlled by the dealer, or both. For example, a dealer might provide input which opens and closes a wagering period. When the dealer opens the wagering period, the indicators (via control from the table controller based upon the dealer's input) might indicate that the input receiving devices 32 are ready to receive wagers and when the dealer closes the wagering, the indicators may indicate that no more wagering inputs are being accepted (again as controlled from the table controller based upon the dealer's input).

As indicated herein, in one embodiment, input receiving device(s) 32 may move between active and inactive conditions. While the dealer may provide inputs to the table controller 100 to control input receiving device activation and de-activation, such might be at least partially automated. For example, in response to a dealer selecting a "start game" option, the table controller 100 might activate the input receiving devices 32 for purposes of receiving player wagers. The table controller 100 might automatically close wagering after a certain time, such as 1 minute, but automatically de-activating them.

In another embodiment of the invention, the input receiving device(s) 32 might always be active or might be inactive between games but always active during game play. In this embodiment, in order to reduce chance of inadvertent input to the input receiving devices(s), the indicators described above might be utilized. For example, instead of an input receiving device being truly inactivated, the associated indicator may indicate to a player that they should not provide an input to the device (although if the player did, such an inadvertent input might then still be registered).

In one embodiment, the input receiving device(s) 32 may be controlled to change one or more characteristics thereof, such as a sensitivity of the device. As one example, the table controller 100 or another controller might be used to implement a first input sensitivity of an input receiving device, such as relative to the detection of one or more chips, but another or second input sensitivity at another times. For example, an input sensitivity or similar characteristic might be controlled in order to reduce the chances for inadvertent input to the input receiving device 32, such a player's hand inadvertently passing over or near the device. This feature might be used, for example, to distinguish between a true "spin" input (or other input from the player) which is provided by a player's hand or the like, and an inadvertent passing of a portion of the player's hand or another object near the sensor which is not intended as an input. As another example, the input receiving device 32 might be configured to require an input of a length of time, such via detection of a player's hand adjacent to the input receiving device(s) for a period of time which would essentially avoid in inadvertent input from being logged. This type of input receiving device control, particularly relative to a proximity sensor, has particular applicability to the invention where the game may require multiple inputs from a player, including different types of inputs, during different times of the game.

Additional details of methods, devices and systems of the invention will now be described. Another aspect of the invention comprise a method of presenting and playing a game. In one embodiment, the game is played between one or more players (at least one) and a dealer or the house. In one example embodiment of the invention, the method may be implemented relative to a gaming table. The gaming table might comprise the gaming table 20 described above, such as including the various input devices 32, table display 36 and other features, or it might comprise a gaming table which does not include some or all of such features, or might include other features.

Figure 6:
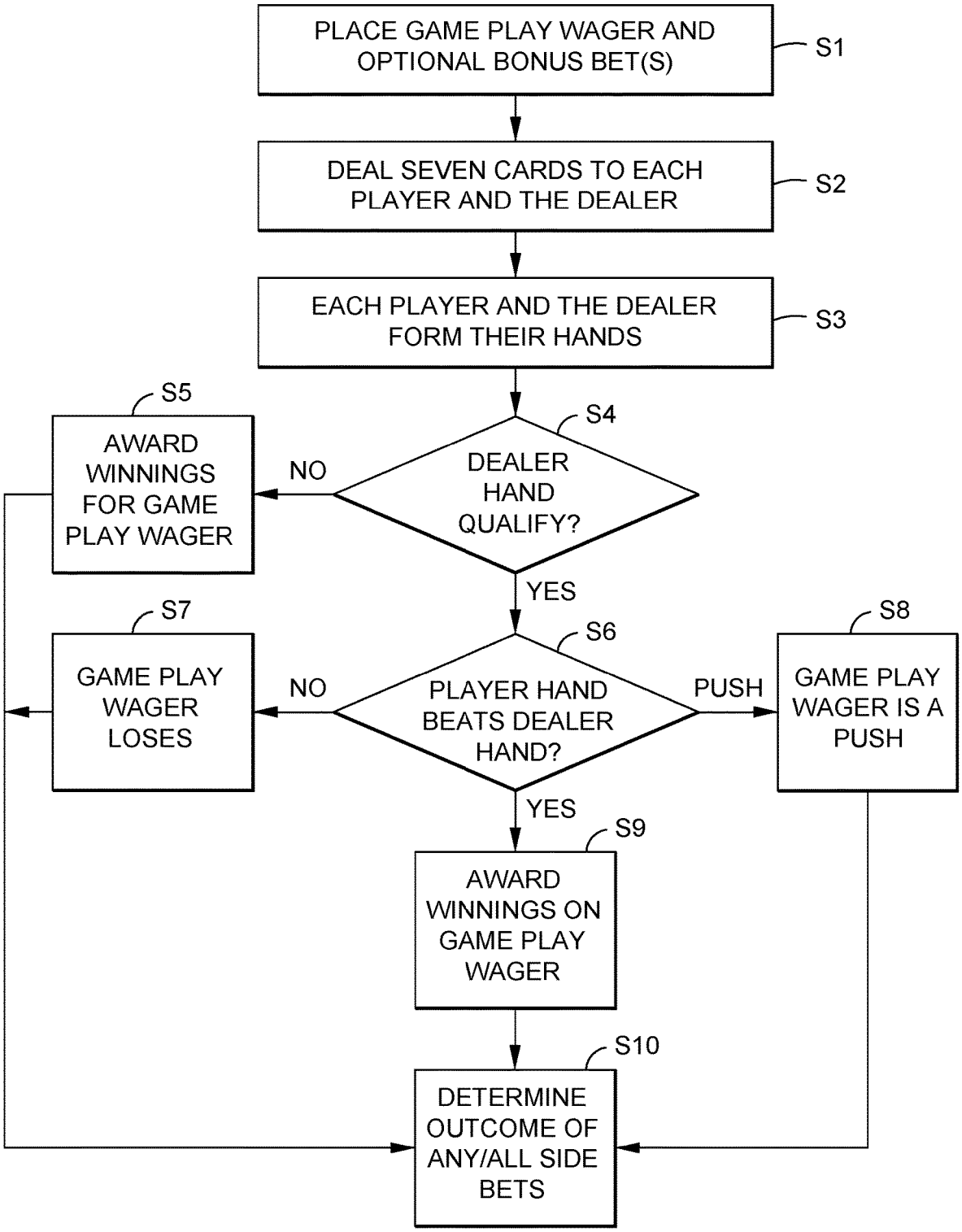
FIG. 6 is a flow diagram which illustrates an embodiment of presenting and playing a game in accordance with the present invention.

Referring to FIG. 6, in a preferred embodiment, the game is played and presented as a wagering game. Thus, in a step S1, a player places one or more wagers. In one embodiment, a player is required to place a game play wager. In one embodiment, a game play wager location 202 is shown or displayed on the gaming table 20, as illustrated in FIG. 1. As indicated above, at least one input sensor 32 may be located at that wager location for detecting a game play wager. In one embodiment, a player places one or more chips, coins or the like at the wager location, such as by locating the one or more chips or the like in proximity to the one or more sensors for detection thereby. The size of the game play wager may have a minimum and/or maximum value.

In one embodiment, a player may optionally place one or more bonus bets (which may also be referred to as side bets or by other terminology, wherein regardless of the terminology used, the bet is in addition to the game play wager). The bonus bets may comprise a first optional bonus bet, such as a bonus bet which is referred to herein as a Flush bonus bet 204. This bonus bet 204 is winning if the player's hand comprises a predetermined winning flush hand. As described below, the one or more bonus bets may instead comprise or also comprise a second optional bonus bet, such as a bonus bet which is referred to herein as a Straight Flush bonus bet 206. This bonus bet 204 is winning if the player's hand comprises a predetermined winning straight flush hand. As also described below, the one or more bonus bets may instead comprise or also comprise a third optional bonus bet, such as a bonus bet which is referred to herein as a Straight to the Wheel bonus bet 208. This bonus bet 208 is winning if the player's hand comprises a predetermined winning straight hand. The player may place the bonus bet(s) at the corresponding bonus bet locations, which again may be associated with one or more input devices 32. Again, each bonus bet may have a required minimum or maximum value. In a preferred embodiment, a player can only place a bonus bet if the player also places a game play wager.

In a step S2, seven (7) cards are dealt to each player and the dealer. In a preferred embodiment, the dealer deals or causes the cards to be dealt, such as from one or more decks of physical playing cards. The one or more decks of cards preferably comprise 52 card decks where the cards have a front and a back, wherein the front or face thereof (but not the back) displays card rank and suit indicia comprising the suits Hearts, Diamonds, Spades and Clubs, with the ranks (from lowest to highest) 2-10, Jack, Queen, King and Ace.

In one embodiment, the one or more decks of cards may be shuffled by a shuffling device which is located at the gaming table and the dealer may deal cards which are provided by the shuffler. In another embodiment, the dealer might deal the cards from a card shoe located at the gaming table, such as from a card shoe device which stores one or more decks of cards and reads the cards as they are dispensed or dealt therefrom. The card shuffler and/or card shoe may be linked to the table controller, such as to provide information regarding read cards and the like.

In one embodiment, seven (7) cards are dealt to each participating player, e.g. a player who has placed the required game play wager, such as detected and registered by the input device 32 and/or as confirmed by the dealer. In one embodiment, the cards are dealt to each player at their player position 30, such as to a card area 210, and the dealer's cards are dealt to the dealer position 28. In one embodiment, the player's cards and the dealer's cards are dealt face down.

In a step S3, each player and the dealer form their hands. Preferably, each player and the dealer form a hand comprising the best Straight, Flush or Straight Flush hand. In one embodiment, hands are ranked as follows, wherein a Straight Flush comprises two or more cards of a consecutive rank of the same suit, a Flush comprises cards of the same suit, and a Straight comprises two or more cards of a consecutive rank but not of the same suit.

First, hands are ranked by the highest number of cards of each of the following hand types, wherein the hands with a higher number of cards of a type outrank hands of lower numbers of cards:

1) Straight Flush (highest)
2) Flush
3) Straight (lowest)

For example, a 5 card Straight would outrank a 4 card Flush.

Next, as between hands having the same number of cards of a hand type, the hand with the highest ranked hand type is ranked the highest. For example, a 5 card Flush would outrank or beat a 5 card Straight.

Lastly, when hands have the same number of cards of the same hand type, then the hand with the highest ranked card or cards would outrank the other hand (wherein the ranks of the individual cards may be traditional of 2 to Ace, wherein 2 has the lowest rank and Ace has the highest rank). For example, a 6 card Flush with a King high would outrank or beat a 6 card Flush with a 9 high card.

Formation of the hands may comprise each player and the dealer simply evaluating their cards for their best hand. In other embodiments, each player and the dealer may separate cards which form their hand from remaining cards, wherein the cards that form the hand may be displayed face-up on the table 20 and the remaining cards might be stacked face-down.

In a step S4, the dealer preferably reveals the dealer hand and it is determined if the dealer's hand qualifies. In one embodiment, this comprises determining if the dealer's hand has a rank of at least a 3 card Straight.

In a step S5, if the dealer's hand does not qualify, then each player's game wager is paid a first winning amount, such as 50% of the amount of the player's wager. For example, if a player placed a $10 game wager, the player's $10 game wager would be returned along with $5 in winnings.

In a step S6, if the dealer's hand does qualify, then it is determined whether the player's hand beats the dealer's hand, ties the dealer's hand, or loses to the dealer's hand. Preferably, this determination is made with reference to the hand rankings noted above.

In a step S7, if the player's hand does not beat the dealer's hand, then the player's game play wager is losing and the dealer/house collects the player's game play wager.

In a step S8, if the player's hand and the dealer's hand tie (have the exact same rank), then the player's game play wager is a push and the player's game play wager is preferably returned with no additional winnings.

In a step S9, if the player's hand beats the dealer's hand, then the player's game play wager is winning and the player's game play wager is preferably returned along with an award of second winnings. In one embodiment, the player's game play wager is paid winnings based upon the following pay table:

TABLE 1

| Game Play Wager pay table | |
|---|---|
| Player Hand | Pay Table |
| 7 Card Flush | 50 to 1 |
| 7 Card Straight | 5 to 1 |
| 6 Card Flush | 3 to 1 |
| 6 Card Straight | 2 to 1 |
| Other Winning Hand | 1 to 1 |

In a step S10, regardless of whether the dealer's hand qualified or not and regardless of the outcome of the player's game play wager, the outcome of each of the player's bonus bets is determined. For example, if placed, the outcome of the player's Flush bonus bet, Straight Flush bonus bet and/or Straight to the Wheel bonus bet, is determined.

The outcome of the player's Flush bonus bet 204 is preferably determined with reference to the following pay table, wherein the player's hand must comprise at least a four (4) card Flush in order to be winning, and winnings are paid as indicated therein.

TABLE 2

| Flush bonus bet pay table | | |
|---|---|---|
| Player Hand | Pay Table 1 | Pay Table 2 |
| Seven Suited Cards | 200 to 1 | 500 to 1 |
| Six Suited Cards | 50 to 1 | 100 to 1 |
| Five Suited Cards | 8 to 1 | 10 to 1 |
| Four Suited Cards | 2 to 1 | 1 to 1 |

The outcome of the player's Straight Flush bonus bet 206 is preferably determined with reference to the following pay table, wherein the player's hand must comprise at least a three (3) card Straight Flush in order to be winning, and winnings are paid as indicated therein (wherein if a particular meter or jackpot does not comprise a whole dollar award value, the amount of the award is rounded up to the next whole dollar value—e.g. a meter amount of $575.56 would be rounded up to an award of $576.00).

TABLE 3

| Straight Flush bonus bet | |
|---|---|
| Hand | Pay Table |
| 7 Card Straight Flush | Meter 1 Plus $25,000 |
| 6 Card Straight Flush | Meter 1 |

TABLE 3-continued

| Straight Flush bonus bet | |
|---|---|
| Hand | Pay Table |
| 4 Card Straight Flush Spades | Meter 2 |
| 4 Card Straight Flush Hearts | Meter 3 |
| 4 Card Straight Flush Diamonds | Meter 4 |
| 4 Card Straight Flush Clubs | Meter 5 |
| 5 Card Straight Flush | $1,250 |
| 3 Card Straight Flush | $30 |

As indicated in Table 3, in a preferred embodiment, certain awards preferably comprise a progressive jackpot—e.g. an award which increases over time based upon amounts wagered, until it the award is one (at which point the award resets). In one embodiment, a portion of each Straight Flush bonus bet is allocated to a progressive jackpot meter and, after being awarded, each meter resets to a base value, pursuant to the following table.

TABLE 4

| Jackpot Meter | Reset Value | Increment Rate |
|---|---|---|
| 1 | $5,000 | 2.50% |
| 2 | $200 | 4.00% |
| 3 | $200 | 4.00% |
| 4 | $200 | 4.00% |
| 5 | $200 | 4.00% |

In another embodiment, the Straight Flush bonus bet might have the following winning outcomes and associated awards:

TABLE 5

| Hand | Pay Table |
|---|---|
| 7 Card Straight Flush | 8000 to 1 |
| 6 Card Straight Flush | 1000 to 1 |
| 5 Card Straight Flush | 100 to 1 |
| 4 Card Straight Flush | 60 to 1 |
| 3 Card Straight Flush | 8 to 1 |

The outcome of the player's Straight to the Wheel bonus bet 208 is preferably winning if the player's hand has a rank of a 5 card Straight, a 6 card Straight or a 7 card Straight. Winnings are then awarded pursuant to the following pay table:

TABLE 6

| Outcome | Pay Table 1 |
|---|---|
| 5 Card Straight | Wheel Amount |
| 6 Card Straight | 3 times the Wheel Amount |
| 7 Card Straight | 10 times the Wheel Amount |

The "wheel amount" set forth in the Table 5 comprise an amount which is awarded as a result of a spin of a bonus or award wheel. Referring to FIG. 1, in one embodiment an award wheel may be displayed graphically on the display 36 at the gaming table 20. Each player who won the Straight to the Wheel bonus bet is given the opportunity to spin the wheel. As indicated above, in one embodiment, an input receiving device 32 may be activated. The player may then wave their hand or provide input to the input receiving device 32. The table controller 100 may then cause the display 36 to display a graphical representation of a spinning wheel which stops at a selected segment which corresponds to define the outcome of the wheel spin, and thus indicate the award which is awarded to the player.

In one embodiment, the input receiving devices 32 located at each participating player position may be activated in sequence. For example, six (6) players may be playing the game of the invention and only players in positions 1, 2 and 5 may have won their Straight to the Wheel bonus bet. In one embodiment, the dealer may indicate that it is time for those players to spin the award wheel to determine their awards. The input receiving device 32 corresponding to the player in position 1 might be activated first (such as by turning green, etc.) while the input receiving devices 32 at all other player locations may remain inactive. The player in position 1 may then provide input to their input device 32, thus initiating the wheel spin event. Thereafter, the input receiving device 32 corresponding to the player in position 1 is de-activated and the one corresponding to the player in position 2 is activated, and so on.

In one embodiment, the virtual wheel may be configured with segments which have associated awards and the probability of a particular segment being selected may be weighted. In the wheel spin event, a random number generator or the like may be used to generate a random number which is then compared to a lookup table of outcomes. The selected outcome corresponds to a segment having an assigned award. The controller may then cause the display 36 to display a wheel spin in which the wheel stops at the selected segment. In this configuration, certain outcomes or awards are more likely to occur than others. Set forth below in Table 7 is one configuration for a virtual award wheel for the Straight to the Wheel bonus bet.

TABLE 7

| Position | Wheel Weight | Prize Type | Pay (to 1) | Value | Frequency | Cost |
|---|---|---|---|---|---|---|
| 1 | 100 | Multiplier | 100 | $100.00 | 0.00333 | 0.33 |
| 2 | 300 | Multiplier | 50 | $50.00 | 0.01000 | 0.50 |
| 3 | 700 | Multiplier | 30 | $30.00 | 0.02333 | 0.70 |
| 4 | 1000 | Multiplier | 20 | $20.00 | 0.03333 | 0.67 |
| 5 | 1100 | Multiplier | 15 | $15.00 | 0.03667 | 0.55 |
| 6 | 2500 | Multiplier | 12 | $12.00 | 0.08333 | 1.00 |
| 7 | 5000 | Multiplier | 10 | $10.00 | 0.16667 | 1.67 |
| 8 | 5000 | Multiplier | 7 | $7.00 | 0.16667 | 1.17 |
| 9 | 5000 | Multiplier | 5 | $5.00 | 0.16667 | 0.83 |
| 10 | 5000 | Multiplier | 4 | $4.00 | 0.16667 | 0.67 |
| 11 | 2800 | Multiplier | 3 | $3.00 | 0.09333 | 0.28 |
| 12 | 1500 | Multiplier | 2 | $2.00 | 0.05000 | 0.10 |
| Total | 30000 | | | | 1.00000 | 8.46 |

In this configuration, there are 30,000 potential outcomes based upon 12 wheel positions or segments, wherein each wheel position or segment has associated odds that it will be selected (such as implemented by a processor executing software to make selections, such as via a random number generator, of a wheel segment).

The outcome of the player's wheel spin is then increased by the amount reflected in Table 6, depending upon the player's hand. For example, a player may win a $10 Straight to the Wheel bonus bet with a 6 card Straight hand. The player may spin the wheel and Position 5 may be selected. This entitles the player to a wheel award of 15 times their wager, or $150, and wherein the player's total winnings then comprises that amount ($150) increased 3 times (because their winning hand was a 6 card Straight hand), for total winnings of $450.

Of course, the wheel spin event could be implemented by spinning a physical spinning wheel, such as where the stopping position of the wheel relative to a pointer or other selector is controlled, such as via a motor. The award selection event might also be represented by other than a wheel spin, but by other events.

Of course, the above method is applied to each participating player in the game (e.g. each player's game play wager and any bonus/side bets is evaluated).

It will be appreciated that the amount of winnings for particular winning outcomes might vary from those set forth herein. In one embodiment, the player may be paid winnings in the form of monetary value chips which are distributed to the player, such as by the dealer from the dealer's chip tray. Of course, the player might be paid winnings in other forms, such as by an increase in an electronic credit balance (which credit balance may preferably be cashed-out by the player by transfer of equivalent funds to a financial account such as a bank account, in the form of monies, etc.).

The game might include additional wagers or bets, such as additional bonus bets. The game might be presented with only certain of the bonus or side bets, but not all of them. It will also be appreciated that the winning values and odds for the bonus bets might vary.

Further, the manner in which awards are paid may vary. For example, instead of awarding winnings for a player's winning Flush bonus bet via a pay table, the player's award could be determined by a wheel spin event. Of course, the award configuration for such a wheel might be different than that for the Straight to the Wheel bonus bet.

While the game may be presented at a gaming table by a live dealer using physical cards, the game may be presented at an automated gaming table. In this embodiment, the cards may automatically be dealt, such as by a card dealing device. It is also possible to present the game at a gaming table using virtual cards. For example, cards may be displayed on one or more video displays. As one example, community cards may be displayed graphically on a common video display and a player's cards may be displayed on a separate player display.

The game might also be presented at one or more electronic gaming devices or gaming machines, or via kiosks or the like which are tied or linked to a gaming table.

Figure 7:
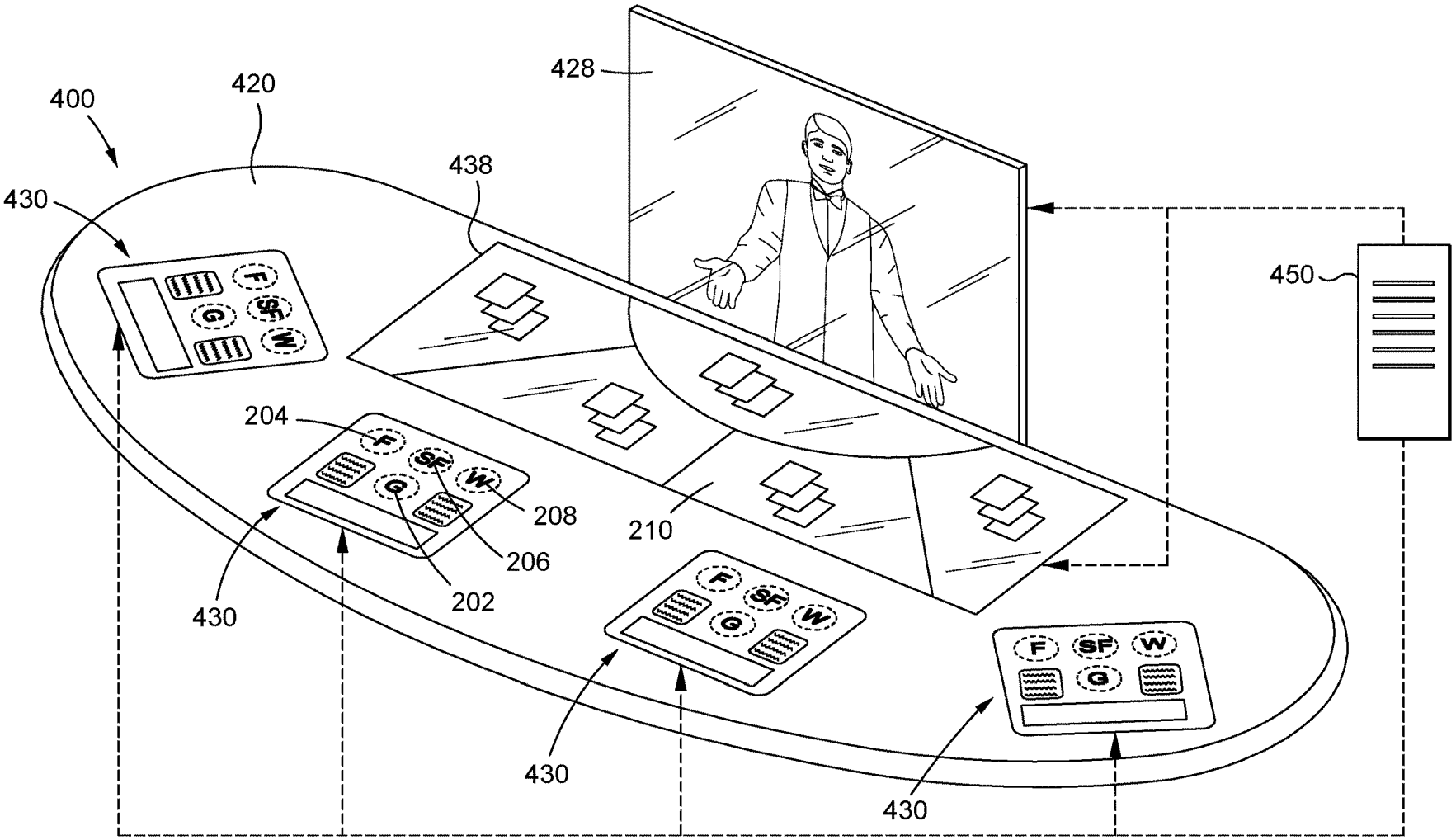
FIG. 7 illustrates another embodiment of a device for presenting and playing a game of the invention.

For example, FIG. 7 illustrates an electronically based device, such as an "e-table" 400. The e-table 400 has a housing 420. In one embodiment, the e-table 420 has a plurality of player stations 430. Each player station 430 comprises at least one electronic display and one or more player input devices, such as a touch-screen interface, buttons or the like. Each player station 430 may be configured to display information such as that illustrated in FIG. 1, such as a game play wagering location 202 and bonus bet locations 204, 206, 208. In one embodiment, a player may place a wager by selecting an amount (such as via the touchscreen) and then touching the wagering or bet location. Of course, the player stations 430 might be configured to display a wide variety of information.

In one embodiment, the e-table 400 also includes a table display 438. The table display 438 may be configured to display game-play related information to all of the players. In one embodiment, for example, card information 210 may be displayed to each player, such as a plurality of cards dealt to each player. In one embodiment, the card information may also comprise cards dealt or being played by the dealer.

In this embodiment, the dealer might be represented graphically, such as by a video representation or graphical representation, such as displayed on a dealer display 428. In one embodiment, the dealer display 428 is generally vertically oriented and faces forward.

One or more table controllers 450 (which preferably comprise a processor, a memory, machine-readable code stored in the memory and executable by the processor, and one or more communication interfaces, such as video device interfaces) may be used to control the e-table elements, such as the video displays, to receive inputs from players and process those inputs, to generate game information (or when remotely generated by an external game server, receive and process that information) for display on the displays, etc. As indicated, the table controller 450 may be interfaced with other systems or devices, such as a ticketing system, a player tracking system, an accounting system or the like.

Presentation and play of a game of the invention using the e-table 400 is similar to that illustrated in FIG. 6 and described above. First, each player places a game play wager. As indicated, this might be accomplished by the input device(s) associated with the player's player station 430, such as the touch screen. Each player may similarly place one or more optional bonus bets such as those described above.

In this embodiment, instead of dealing physical cards, dealt cards may be displayed graphically, such as on the main table display 438 and/or at the player stations 430. In one embodiment, the step of dealing may be graphically represented by displaying a virtual dealer 428 who appears to deal the cards. The virtual dealer may also provide game play instructions, such as via one or more speakers.

Once again, the player and dealer hands are evaluated in a similar manner to that described above. In this configuration, wagers may be placed from an electronic credit balance (rather than via chips) and winnings may be paid by credits which increase the player's credit balance. The player might cash-out by requesting a value ticket which can be redeemed for monetary funds, by moving their credit balance to an electronic monetary account (at the casino or at a bank, etc.) or the like.

In this embodiment, if a player wins the Straight to the Wheel bonus bet, the player may make a "spin" input to the touchscreen of their player station 430. This input may cause a virtual wheel which may be displayed on the table display 438 or a separate wheel display (not shown) to display a wheel segment selection event.

The game has numerous advantages. The game which offers a unique combination of features and elements which result in a game which is exciting to the player and viable for the house. Among other thing, the game is configured to allow the player to play the dealer rather than other players.

Further, the game is not as complex as poker games, including games such as Texas Hold'em, Omaha Hold'em or the like, either as to the betting sequence or the formation of winning hands. In particular, the player of the present game needs to only form a best Flush, Straight or Straight Flush hand, and is not required to form that hand from community cards and does not need to make complex decisions regarding which card to discard or hold.

Also, the player is only required to place a single game play wager to play the game. The player thus does not need to make later decisions, such as based upon an incomplete hand or the like, as to whether to make further wagers or to fold and lose their already placed wagers.

Yet another advantage of the game is that the player does not need to have a particular hand or else loses the game. Instead, the player wins automatically if the dealer's hand does not qualify.

As another aspect of the game, a player may place and have the opportunity to win one or more optional bonus bets. In the preferred embodiment, the outcome of these bonus bets is determined regardless of the outcome of the player's game play wager.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting a game to at least two players at player positions of a gaming table, comprising the steps of:

utilizing a table controller to activate, for an activation period, a first, a second, a third and a fourth input receiving device at each player position of said gaming table to enable said input receiving devices to receive wagers during said activation period;

determining whether each player has placed a game play wager comprising sensing at least one wagering chip via said first input receiving device of the player position corresponding to the player while said first input receiving device is activated;

determining whether each player has placed a first bonus bet, comprising sensing at least one wagering chip via said second input receiving device of the player position corresponding to the player while said second input receiving device is activated;

determining whether each player has placed a second bonus bet, comprising sensing at least one wagering chip via said third input receiving device of the player position corresponding to the player while said third input receiving device is activated;

determining whether each player has placed a third bonus bet, comprising sensing at least one wagering chip via said fourth input receiving device of the player position corresponding to the player while said fourth input receiving device is activated;

deactivating said first, second, third and fourth input receiving devices at said player positions in response to a signal from said table controller;

registering each game play wager and first, second and third bonus bets placed by said players at said table controller;

displaying, based upon an output of said table controller, an indication to a dealer of each player that placed said game play wager;

based upon said indication that said player placed said game play wager, dealing seven physical playing cards to said player and a dealer from at least one deck of physical playing cards;

determining an outcome of said player's game play wager with reference either or both a rank of a player hand formed from said seven cards dealt to said player and a rank of a dealer hand formed from said seven cards dealt to said dealer, wherein hands are ranked by the highest number of cards of each of hand types ranked from highest to lowest of Straight Flush, Flush and Straight, wherein a hand with a higher number of cards of any hand type outranks a hand of a lower number of cards of any hand type, whereas between hands having the same number of cards of one of the hand types, the hand with the highest ranked hand type is ranked the highest, and wherein when hands have the same number of cards of the same hand type, then the hand with the highest ranked card or cards outranks the other hand, wherein an outcome of said player's game play wager is a first winning outcome if said rank of said dealer hand does not meet a predetermined qualifying rank, wherein said outcome of said player's game play wager is a push if said rank of said dealer hand and said rank of said player hand are the same, wherein said outcome of said player's game play wager is losing if said rank of said dealer hand is higher than said rank of said player's hand, and wherein said player's game play wager is a second winning outcome if said rank of said player's hand is higher than said rank of said dealer hand;

awarding said player first winnings for a first winning outcome, returning said player's game play wager if said outcome of said player's game play wager is a push, and awarding said player second winnings for a second winning outcome; and relative to each first bonus bet, second bonus bet and/or third bonus bet placed by each player, determining an outcome of each of said first bonus bet, said second bonus bet and said third bonus bet with reference to said rank of said player's hand, wherein when said outcome of said third bonus bet is winning, activating, via signal from said table controller, one of said first, second, third or fourth input receiving devices, receiving a player spin input to said one of said input receiving devices at said table controller, and utilizing said table controller to cause a video display associated with said gaming table to display a wheel spin award selection event, said wheel spin award selection event comprising the random selection of an award outcome from a paytable of award outcomes and the display of a wheel spin representing said selected award outcome.

2. The method in accordance with claim 1 wherein said predetermined qualifying rank comprises at least a 3 card Straight.

3. The method in accordance with claim 1 wherein said second winnings comprise an amount paid based upon said player's game play wager according to the paytable:

| Player Hand | Pay Table |
|---|---|
| 7 Card Flush | 50 to 1 |
| 7 Card Straight | 5 to 1 |
| 6 Card Flush | 3 to 1 |
| 6 Card Straight | 2 to 1 |
| Other Winning Hand | 1 to 1 |

4. The method in accordance with claim 1 wherein said first bonus bet comprises a Flush bonus bet and said step of determining an outcome of said Flush bonus bet comprises declaring said Flush bonus bet to be winning if said player hand comprises a Flush hand having at least four cards and awarding an award for a winning optional Flush bonus bet.

5. The method in accordance with claim 4 wherein said award for a winning optional Flush bonus bet is paid based upon said player's Flush bonus bet according to the paytable:

| Player Hand | Pay Table 1 | Pay Table 2 |
|---|---|---|
| Seven Suited Cards | 200 to 1 | 500 to 1 |
| Six Suited Cards | 50 to 1 | 100 to 1 |

-continued

| Player Hand | Pay Table 1 | Pay Table 2 |
|---|---|---|
| Five Suited Cards | 8 to 1 | 10 to 1 |
| Four Suited Cards | 2 to 1 | 1 to 1 |

6. The method in accordance with claim 1 wherein said second bonus bet comprises a Straight Flush bonus bet and said step of determining an outcome of said Straight Flush bonus bet comprises declaring said Straight Flush bonus bet to be winning if said player hand comprises a Straight Flush having at least three cards, and awarding an award for a winning optional Straight Flush bonus bet.

7. The method in accordance with claim 6 wherein said award for a winning optional Straight Flush bonus bet is paid according to the paytable:

| Hand | Pay Table |
|---|---|
| 7 Card Straight Flush | Meter 1 Plus $25,000 |
| 6 Card Straight Flush | Meter 1 |
| 4 Card Straight Flush Spades | Meter 2 |
| 4 Card Straight Flush Hearts | Meter 3 |
| 4 Card Straight Flush Diamonds | Meter 4 |
| 4 Card Straight Flush Clubs | Meter 5 |
| 5 Card Straight Flush | $1,250 |
| 3 Card Straight Flush | $30 |

8. The method in accordance with claim 7, wherein said meters each have amounts having a reset value and increment rate based upon placed Straight Flush bonus bets of:

| Jackpot Meter | Reset Value | Increment Rate |
|---|---|---|
| 1 | $5,000 | 2.50% |
| 2 | $200 | 4.00% |
| 3 | $200 | 4.00% |
| 4 | $200 | 4.00% |
| 5 | $200 | 4.00% |

9. The method in accordance with claim 6 wherein said award for a winning optional Straight Flush bonus bet is paid according to the paytable:

| Hand | Pay Table |
|---|---|
| 7 Card Straight Flush | 8000 to 1 |
| 6 Card Straight Flush | 1000 to 1 |
| 5 Card Straight Flush | 100 to 1 |
| 4 Card Straight Flush | 60 to 1 |
| 3 Card Straight Flush | 8 to 1 |

10. The method in accordance with claim 1, wherein said third bonus bet comprises a Straight to the Wheel bonus bet and said step of determining an outcome of said Straight to the Wheel bonus bet comprises declaring said Straight to the Wheel bonus bet to be winning if said player hand comprises a 5, 6 or 7 card Straight.

11. The method in accordance with claim 1 wherein said step of receiving a spin input comprises detecting at least a portion of said player's hand adjacent to said one of said input receiving devices.

12. The method in accordance with claim 1 wherein said first winnings comprise an award of 50% of the player's game play wager.

13. The method in accordance with claim 1 wherein said first, second, third and fourth input receiving devices each comprise a proximity sensor.

14. The method in accordance with claim 1 wherein said physical playing cards are dealt from a card shoe which reads said cards as they are dealt.

15. The method in accordance with claim 1, wherein said first bonus bet comprises an optional Flush bonus bet that is winning if said player's hand comprises 4, 5, 6 or 7 cards of the same suit, said second bonus bet comprises an optional Straight Flush bonus bet that is winning if said player's hand comprises a straight flush of at least 3 cards, and said third bonus bet comprises an optional Straight to the Wheel bonus bet that is winning if said player's hand comprises a 5, 6 or 7 card Straight.

16. The method in accordance with claim 1 wherein said selection of an award outcome from a paytable of award outcomes comprises comparison of a randomly generated number to a table of award positions populated by different awards, the frequencies o said different awards varying.

* * * * *